US007170424B2

(12) United States Patent
Vinegar et al.

(10) Patent No.: US 7,170,424 B2
(45) Date of Patent: Jan. 30, 2007

(54) OIL WELL CASTING ELECTRICAL POWER PICK-OFF POINTS

(75) Inventors: Harold J. Vinegar, Houston, TX (US); Robert Rex Burnett, Katy, TX (US); William Mountjoy Savage, Houston, TX (US); Frederick Gordon Carl, Jr., Houston, TX (US); John Michele Hirsch, Houston, TX (US)

(73) Assignee: Shell Oil Company, Houston, TX (US)

( * ) Notice: Subject to any disclaimer, the term of this patent is extended or adjusted under 35 U.S.C. 154(b) by 746 days.

(21) Appl. No.: 10/220,402

(22) PCT Filed: Mar. 2, 2001

(86) PCT No.: PCT/US01/07004

§ 371 (c)(1),
(2), (4) Date: Aug. 29, 2002

(87) PCT Pub. No.: WO01/65069

PCT Pub. Date: Sep. 7, 2001

(65) Prior Publication Data

US 2003/0066671 A1 Apr. 10, 2003

Related U.S. Application Data

(60) Provisional application No. 60/186,379, filed on Mar. 2, 2000.

(51) Int. Cl.
*G01V 3/02* (2006.01)

(52) U.S. Cl. ..... 340/855.8; 166/66; 367/35

(58) Field of Classification Search ..... 340/855.8, 340/854.8, 854.4, 854.3, 853.2, 853.7; 166/66; 367/35, 83

See application file for complete search history.

(56) References Cited

U.S. PATENT DOCUMENTS 525,663 A 9/1894 Mottinger (Continued)

FOREIGN PATENT DOCUMENTS

EP 28296 5/1981

(Continued)

OTHER PUBLICATIONS

Brown, Connolizo and Robertson, West Texas Oil Lifting Short Course and H.W. Winkler, "Misunderstood or overlooked Gas-Lift Design and Equipment Considerations," SPE, pp. 351-368 (1994).

(Continued)

*Primary Examiner*—Wendy R. Garber
*Assistant Examiner*—Hung Q Dang
(74) *Attorney, Agent, or Firm*—Rachael A. Stiegel

(57) ABSTRACT

A power supply apparatus is provided for supplying power and communications within a first piping structure. An external power transfer device is positioned around the first piping structure and is magnetically coupled to an internal power transfer device. The internal power transfer device is positioned around a second piping structure disposed within the first piping structure. A main surface current flowing on the first piping structure induces a first surface current within the external power transfer device. The first surface current causes a second surface current to be induced within the internal power transfer device.

16 Claims, 5 Drawing Sheets

U.S. PATENT DOCUMENTS

| | | | | |
|---|---|---|---|---|
| 2,917,004 | A | 12/1959 | Davis et al. | 103/233 |
| 3,083,771 | A | 4/1963 | Chapman | 166/146 |
| 3,247,904 | A | 4/1966 | Wakefield, Jr. | 166/116 |
| 3,427,989 | A | 2/1969 | Bostock et al. | 103/232 |
| 3,566,963 | A | 3/1971 | Blackledge | 166/189 |
| 3,602,305 | A | 8/1971 | Kisling, III | 116/134 |
| 3,732,728 | A | 5/1973 | Fitzpatrick | 73/151 |
| 3,793,632 | A | 2/1974 | Still | 340/18 |
| 3,814,545 | A | 6/1974 | Waters | 417/90 |
| 3,837,618 | A | 9/1974 | Juhel | 251/129 |
| 3,980,826 | A | 9/1976 | Widmer | 178/68 |
| 4,068,717 | A | 1/1978 | Needham | 166/272 |
| 4,087,781 | A | 5/1978 | Grossi et al. | 340/18 |
| 4,295,795 | A | 10/1981 | Gass et al. | 417/111 |
| 4,393,485 | A | 7/1983 | Redden | 367/25 |
| 4,468,665 | A | 8/1984 | Thawley et al. | |
| 4,545,731 | A | 10/1985 | Canalizo et al. | 417/86 |
| 4,576,231 | A | 3/1986 | Dowling et al. | 166/248 |
| 4,578,675 | A | 3/1986 | MacLeod | |
| 4,596,516 | A | 6/1986 | Scott et al. | 417/58 |
| 4,630,243 | A | 12/1986 | MacLeod | 367/82 |
| 4,648,471 | A | 3/1987 | Bordon | |
| 4,662,437 | A | 5/1987 | Renfro | 166/65.1 |
| 4,681,164 | A | 7/1987 | Stacks | 166/304 |
| 4,709,234 | A | 11/1987 | Forehand et al. | 340/856 |
| 4,738,313 | A | 4/1988 | McKee | 166/372 |
| 4,739,325 | A | 4/1988 | MacLeod | |
| 4,839,644 | A | 6/1989 | Safinya et al. | |
| 4,886,114 | A | 12/1989 | Perkins et al. | 166/65.1 |
| 4,901,069 | A | 2/1990 | Veneruso | 340/853 |
| 4,933,640 | A * | 6/1990 | Kuckes | 324/339 |
| 4,972,704 | A | 11/1990 | Wellington et al. | 73/155 |
| 4,981,173 | A | 1/1991 | Perkins et al. | 166/66.4 |
| 5,001,675 | A | 3/1991 | Woodward | 367/13 |
| 5,008,664 | A * | 4/1991 | More et al. | 340/854.8 |
| 5,130,706 | A | 7/1992 | Van Steenwyk | |
| 5,134,285 | A | 7/1992 | Perry et al. | 250/269 |
| 5,160,925 | A | 11/1992 | Dailey et al. | 340/853.3 |
| 5,162,740 | A | 11/1992 | Jewell | 324/347 |
| 5,172,717 | A | 12/1992 | Boyle et al. | 137/155 |
| 5,176,164 | A | 1/1993 | Boyle | 137/155 |
| 5,191,326 | A | 3/1993 | Montgomery | 340/855.5 |
| 5,230,383 | A | 7/1993 | Pringle et al. | 166/66.4 |
| 5,246,860 | A | 9/1993 | Hutchins et al. | 436/27 |
| 5,251,328 | A | 10/1993 | Shaw | 455/73 |
| 5,257,663 | A | 11/1993 | Pringle et al. | 166/66.4 |
| 5,267,469 | A | 12/1993 | Espinoza | 73/40.5 |
| 5,278,758 | A | 1/1994 | Perry et al. | 364/422 |
| 5,331,318 | A | 7/1994 | Montgomery | 340/855.4 |
| 5,353,627 | A | 10/1994 | Diatschenko et al. | 73/19.03 |
| 5,358,035 | A | 10/1994 | Grudzinski | 166/53 |
| 5,367,694 | A | 11/1994 | Ueno | 395/800 |
| 5,394,141 | A | 2/1995 | Soulier | 340/854.4 |
| 5,396,232 | A | 3/1995 | Mathieu et al. | 340/854.5 |
| 5,425,425 | A | 6/1995 | Bankston et al. | 166/377 |
| 5,447,201 | A | 9/1995 | Mohn | 166/375 |
| 5,458,200 | A | 10/1995 | Lagerlef et al. | 166/372 |
| 5,467,083 | A | 11/1995 | McDonald et al. | |
| 5,473,321 | A | 12/1995 | Goodman et al. | 340/854.9 |
| 5,493,288 | A | 2/1996 | Henneuse | |
| 5,531,270 | A | 7/1996 | Fletcher et al. | 166/53 |
| 5,561,245 | A | 10/1996 | Georgi et al. | 73/152.02 |
| 5,574,374 | A | 11/1996 | Thompson et al. | |
| 5,576,703 | A | 11/1996 | MacLeod | |
| 5,587,707 | A | 12/1996 | Dickie et al. | 340/870.09 |
| 5,592,438 | A | 1/1997 | Rorden et al. | 367/83 |
| 5,662,165 | A | 9/1997 | Tubel et al. | 166/250.01 |
| 5,723,781 | A | 3/1998 | Pruett et al. | 73/152.18 |
| 5,730,219 | A | 3/1998 | Tubel et al. | 66/250.01 |
| 5,745,047 | A | 4/1998 | Van Gisbergen et al. | 340/853.1 |
| 5,782,261 | A | 7/1998 | Becker et al. | 137/155 |
| 5,797,453 | A | 8/1998 | Hisaw | 166/117.5 |
| 5,881,807 | A | 3/1999 | Boe et al. | 166/100 |
| 5,883,516 | A | 3/1999 | Van Steenwyk et al. | |
| 5,887,657 | A | 3/1999 | Bussear et al. | |
| 5,896,924 | A | 4/1999 | Carmody et al. | 166/53 |
| 5,934,371 | A | 8/1999 | Bussear et al. | 166/53 |
| 5,937,945 | A | 8/1999 | Bussear et al. | 166/250.15 |
| 5,941,307 | A | 8/1999 | Tubel | 166/313 |
| 5,955,666 | A | 9/1999 | Mullins | 73/152.18 |
| 5,959,499 | A | 9/1999 | Khan et al. | 330/149 |
| 5,960,883 | A | 10/1999 | Tubel et al. | 166/313 |
| 5,963,090 | A | 10/1999 | Fukuchi | 330/149 |
| 5,971,072 | A | 10/1999 | Huber et al. | 166/297 |
| 5,975,204 | A | 11/1999 | Tubel et al. | 166/250.15 |
| 5,995,020 | A | 11/1999 | Owens et al. | 340/854.9 |
| 6,012,015 | A | 1/2000 | Tubel | 702/6 |
| 6,012,016 | A | 1/2000 | Bilden et al. | 702/12 |
| 6,070,608 | A | 6/2000 | Pringle | 137/155 |
| 6,123,148 | A | 9/2000 | Oneal | 166/118 |
| 6,148,915 | A | 11/2000 | Mullen et al. | 166/278 |
| 6,192,983 | B1 | 2/2001 | Neuroth et al. | 166/250.15 |
| 6,208,586 | B1 | 3/2001 | Rorden et al. | 367/35 |
| 6,334,486 | B1 | 1/2002 | Carmody et al. | 166/53 |
| 6,484,800 | B2 | 11/2002 | Carmody et al. | 166/53 |

FOREIGN PATENT DOCUMENTS

| | | | |
|---|---|---|---|
| EP | 295178 | A2 | 12/1988 |
| EP | 339825 | A1 | 4/1989 |
| EP | 492856 | A2 | 7/1992 |
| EP | 641916 | | 3/1995 |
| EP | 681090 | A2 | 11/1995 |
| EP | 697500 | A2 | 2/1996 |
| EP | 0 721 053 | A1 | 7/1996 |
| EP | 732053 | | 9/1996 |
| EP | 919696 | A2 | 6/1999 |
| EP | 922835 | A2 | 6/1999 |
| EP | 0 930 518 | A2 | 7/1999 |
| EP | 0 964 134 | A2 | 12/1999 |
| EP | 927909 | A2 | 1/2000 |
| EP | 999341 | A2 | 5/2000 |
| FR | 2677134 | | 12/1992 |
| GB | 2083321 | A | 3/1982 |
| GB | 2325949 | A | 2/1999 |
| GB | 2327695 | A | 2/1999 |
| GB | 2338253 | A | 12/1999 |
| WO | 80/00727 | | 4/1980 |
| WO | 96/00836 | | 1/1996 |
| WO | 96/24747 | | 8/1996 |
| WO | 97/16751 | | 5/1997 |
| WO | 97 37103 | | 10/1997 |
| WO | 98/20233 | | 5/1998 |
| WO | 99/37044 | | 7/1999 |
| WO | 99/57417 | | 11/1999 |
| WO | 99/60247 | | 11/1999 |
| WO | 00/04275 | | 1/2000 |
| WO | 00/37770 | | 6/2000 |
| WO | 01/20126 | A2 | 3/2001 |
| WO | 01/55555 | A1 | 8/2001 |

OTHER PUBLICATIONS

Der Spek, Alex, and Aliz Thomas, "Neural-Net Identification of Flow Regime with Band Spectra of Flow-Generated Sound", SPE Reservoir Eva. & Eng.2 (6) Dec. 1999, pp. 489-498.

Sakata et al., "Performance Analysis of Long Distance Transmitting of Magnetic Signal on Cylindrical Steel Rod", IEEE Translation Journal on magnetics in Japan, vol. 8, No. 2. Feb. 1993, pp. 102-106.

Otis Engineering, Aug. 1980, "Heavy Crude Lift System", Field Development Report, OEC 5228, Otis Corp., Dallas, Texas, 1980.

Office Action dated Sep. 22, 2003, U.S. Appl. No. 09/769,048, Bass.
Office Action dated Jan. 29, 2003, U.S. Appl. No. 09/769,048, Bass.
Office Action dated Oct. 24, 2003, U.S. Appl. No. 09/768,705, Vinegar.
Office Action dated Feb. 21, 2003, U.S. Appl. No. 09/768,705, Vinegar.
Office Action dated Feb. 28, 2002, U.S. Appl. No. 09/768,705, Vinegar.
Office Action dated Apr. 8, 2005, U.S. Appl. No. 10/220,253, Hirsch.
Office Action dated Jan. 13, 2005, U.S. Appl. No. 10/220,195, Vinegar.
Office Action dated Sep. 13, 2004, U.S. Appl. No. 10/220,195, Vinegar.
Office Action dated Jun. 3, 2004, U.S. Appl. No. 10/220,195, Vinegar.
Office Action dated Nov. 12, 2003, U.S. Appl. No. 10/220,195, Vinegar.

* cited by examiner 60
61
24
CURRENT
65
62
42
64
CURRENT

OIL WELL CASTING ELECTRICAL POWER PICK-OFF POINTS

CROSS-REFERENCES TO RELATED APPLICATIONS

This application claims the benefit of the following U.S. Provisional Applications, all of which are hereby incorporated by reference:

COMMONLY OWNED AND PREVIOUSLY FILED U.S. PROVISIONAL PATENT APPLICATIONS

| T&K # | Ser. No. | Title | Filing Date |
|---|---|---|---|
| TH 1599 | 60/177,999 | Toroidal Choke Inductor for Wireless Communication and Control | Jan. 24, 2000 |
| TH 1600 | 60/178,000 | Ferromagnetic Choke in Wellhead | Jan. 24, 2000 |
| TH 1602 | 60/178,001 | Controllable Gas-Lift Well and Valve | Jan. 24, 2000 |
| TH 1603 | 60/177,883 | Permanent, Downhole, Wireless, Two-Way Telemetry Backbone Using Redundant Repeater, Spread Spectrum Arrays | Jan. 24, 2000 |
| TH 1668 | 60/177,998 | Petroleum Well Having Downhole Sensors, Communication, and Power | Jan. 24, 2000 |
| TH 1669 | 60/177,997 | System and Method for Fluid Flow Optimization | Jan. 24, 2000 |
| TS 6185 | 60/181,322 | A Method and Apparatus for the Optimal Predistortion of an Electromagnetic Signal in a Downhole Communications System | Feb. 9, 2000 |
| TH 1599x | 60/186,376 | Toroidal Choke Inductor for Wireless Communication and Control | Mar. 2, 2000 |
| TH 1600x | 60/186,380 | Ferromagnetic Choke in Wellhead | Mar. 2, 2000 |
| TH 1601 | 60/186,505 | Reservoir Production Control from Intelligent Well Data | Mar. 2, 2000 |

-continued

COMMONLY OWNED AND PREVIOUSLY FILED U.S. PROVISIONAL PATENT APPLICATIONS

| T&K # | Ser. No. | Title | Filing Date |
|---|---|---|---|
| TH 1671 | 60/186,504 | Tracer Injection in a Production Well | Mar. 2, 2000 |
| TH 1672 | 60/186,379 | Oilwell Casing Electrical Power Pick-Off Points | Mar. 2, 2000 |
| TH 1673 | 60/186,394 | Controllable Production Well Packer | Mar. 2, 2000 |
| TH 1674 | 60/186,382 | Use of Downhole High Pressure Gas in a Gas Lift Well | Mar. 2, 2000 |
| TH 1675 | 60/186,503 | Wireless Smart Well Casing | Mar. 2, 2000 |
| TH 1677 | 60/186,527 | Method for Downhole Power Management Using Energization from Distributed Batteries or Capacitors with Reconfigurable Discharge | Mar. 2, 2000 |
| TH 1679 | 60/186,393 | Wireless Downhole Well Interval Inflow and Injection Control | Mar. 2, 2000 |
| TH 1681 | 60/186,394 | Focused Through-Casing Resistivity Measurement | Mar. 2, 2000 |
| TH 1704 | 60/186,531 | Downhole Rotary Hydraulic Pressure for Valve Actuation | Mar. 2, 2000 |
| TH 1705 | 60/186,377 | Wireless Downhole Measurement and Control For Optimizing Gas Lift Well and Field Performance | Mar. 2, 2000 |
| TH 1722 | 60/186,381 | Controlled Downhole Chemical Injection | Mar. 2, 2000 |
| TH 1723 | 60/186,378 | Wireless Power and Communications Cross-Bar Switch | Mar. 2, 2000 |

The current application shares some specification and figures with the following commonly owned and concurrently filed applications, all of which are hereby incorporated by reference:

COMMONLY OWNED AND CONCURRENTLY FILED U.S. PATENT APPLICATIONS

| T&K # | Ser. No. | Title | Filing Date |
|---|---|---|---|
| TH 1601US | 60/186505<br>10/220254 | Reservoir Production Control from Intelligent Well Data | Mar. 2, 2000<br>Aug. 29, 2002 |
| TH 1671US | 60/186504<br>10/220251 | Tracer Injection in a Production Well | Mar. 2, 2000<br>Aug. 29, 2002 |
| TH 1673US | 60/186375<br>10/220249 | Controllable Production Well Packer | Mar. 2, 2000<br>Aug. 29, 2002 |
| TH 1674US | 60/186382<br>10/220249 | Use of Downhole High Pressure Gas in a Gas Lift Well | Mar. 2, 2000<br>Aug. 29, 2002 |
| TH 1675US | 60/186503<br>10/220195 | Wireless Smart Well Casing | Mar. 2, 2000<br>Aug. 28, 2002 |
| TH 1677US | 60/186527 | Method for Downhole Power Management Using Energization from Distributed Batteries or Capacitors with Reconfigurable Discharge | Mar. 2, 2000 |
| TH 1679US | 60/186393<br>10/220453 | Wireless Downhole Well Interval Inflow and Injection Control | Mar. 2, 2000<br>Aug. 28, 2003 |
| TH 1681US | 60/186394<br>09/798192 | Focused Through-Casing Resistivity Measurement | Mar. 2, 2000<br>Mar. 2, 2001 |

-continued

| COMMONLY OWNED AND CONCURRENTLY FILED U.S. PATENT APPLICATIONS | | | |
|---|---|---|---|
| T&K # | Ser. No. | Title | Filing Date |
| TH 1704US | 60/186531<br>09/798326 | Downhole Rotary Hydraulic Pressure for Valve Actuation | Mar. 2, 2000<br>Aug. 29, 2002 |
| TH 1705US | 60/186377<br>10/220455 | Wireless Downhole Measurement and Control For Optimizing Gas Lift Well and Field Performance | Mar. 2, 2000<br>Aug. 29, 2002 |
| TH 1722US | 60/186381<br>10/220372 | Controlled Downhole Chemical Injection | Mar. 2, 2000<br>Aug. 30, 2002 |
| TH 1723US | 60/186378<br>10/220652 | Wireless Power and Communications Cross-Bar Switch | Mar. 2, 2000<br>Aug. 30, 2002 |

The current application shares some specification and figures with the following commonly owned and previously filed applications, all of which are hereby incorporated by reference:

| COMMONLY OWNED AND PREVIOUSLY FILED U.S. PATENT APPLICATIONS | | | |
|---|---|---|---|
| T&K # | Ser. No. | Title | Filing Date |
| TH 1599US | 60/177999 | Choke Inductor for Wireless Communication and Control | Jan. 24, 2000 |
| TH 1600US | 60/178000 | Induction Choke for Power Distribution in Piping Structure | Jan. 24, 2000 |
| TH 1602US | 60/178001 | Controllable Gas-Lift Well and Valve | Jan. 24, 2000 |
| TH 1603US | 60/177883 | Permanent Downhole, Wireless, Two-Way Telemetry Backbone Using Redundant Repeater | Jan. 24, 2000 |
| TH 1668US | 60/177988 | Petroleum Well Having Downhole Sensors, Communication, and Power | Jan. 24, 2000 |
| TH 1669US | 60/177997 | System and Method for Fluid Flow Optimization | Jan. 24, 2000 |
| TH 1783US | 60/263,932 | Downhole Motorized Flow Control Valve | Jan. 24, 2000 |
| TS 6185US | 60/181322 | A Method and Apparatus for the Optimal Predistortion of an Electro Magnetic Signal in a Downhole Communications System | Feb. 9, 2000 |

BACKGROUND OF THE INVENTION

1. Field of the Invention

The present invention relates to a petroleum well having a casing which is used as a conductive path to transmit AC electrical power and communication signals from the surface to downhole equipment located proximate the casing, and in particular where the formation ground is used as a return path for the AC circuit.

2. Description of Related Art

Communication between two locations in an oil or gas well has been achieved using cables and optical fibers to transmit signals between the locations. In a petroleum well, it is, of course, highly undesirable and in practice difficult to use a cable along the tubing string either integral to the tubing string or spaced in the annulus between the tubing string and the casing. The use of a cable presents difficulties for well operators while assembling and inserting the tubing string into a borehole. Additionally, the cable is subjected to corrosion and heavy wear due to movement of the tubing string within the borehole. An example of a downhole communication system using a cable is shown in PCT/EP97/01621.

U.S. Pat. No. 4,839,644 describes a method and system for wireless two-way communications in a cased borehole having a tubing string. However, this system describes a communication scheme for coupling electromagnetic energy in a TEM mode using the annulus between the casing and the tubing. This coupling requires a substantially nonconductive fluid such as crude oil in the annulus between the casing and the tubing. Therefore, the invention described in U.S. Pat. No. 4,839,644 has not been widely adopted as a practical scheme for downhole two-way communication.

Another system for downhole communication using mud pulse telemetry is described in U.S. Pat. Nos. 4,648,471 and 5,887,657. Although mud pulse telemetry can be successful at low data rates, it is of limited usefulness where high data rates are required or where it is undesirable to have complex, mud pulse telemetry equipment downhole. Other methods of communicating within a borehole are described in U.S. Pat. Nos. 4,468,665; 4,578,675; 4,739,325; 5,130,706; 5,467,083; 5,493,288; 5,576,703; 5,574,374; and 5,883,516.

PCT application, WO 93/26115 generally describes a communication system for a sub-sea pipeline installation.

Importantly, each sub-sea facility, such as a wellhead, must have its own source of independent power. In the preferred embodiment, the power source is a battery pack for startup operations and a thermoelectric power generator for continued operations. For communications, '115 applies an electromagnetic VLF or ELF signal to the pipe comprising a voltage level oscillating about a DC voltage level. FIGS. 18 and 19 and the accompanying text on pp. 40–42 describe a simple system and method for getting downhole pressure and temperature measurements. However, the pressure and temperature sensors are passive (Bourdon and bimetallic strip) where mechanical displacement of a sensing element varies a circuit to provide resonant frequencies related to temperature and pressure. A frequency sweep at the wellhead looks for resonant spikes indicative of pressure and temperature. The data at the well head is transmitted to the surface by cable or the '115 pipeline communication system.

It would, therefore, be a significant advance in the operation of petroleum wells if an alternate means for communicating and providing power downhole. Furthermore, it would be a significant advance if devices, such as sensors and controllable valves, could be positioned downhole that communicated with and were powered by equipment at the surface of the well.

All references cited herein are incorporated by reference to the maximum extent allowable by law. To the extent a reference may not be fully incorporated herein, it is incorporated by reference for background purposes and indicative of the knowledge of one of ordinary skill in the art.

SUMMARY OF THE INVENTION

The problem of communicating and supplying power downhole in a petroleum well is solved by the present invention. By coupling AC current to a casing located in a borehole of the well, power and communication signals can be supplied within the casing through the use of an external power transfer device and an internal power transfer device. The power and communication signals supplied within the casing can then be used to operate and control various downhole devices.

A power supply apparatus according to the present invention includes an external power transfer device configured for disposition around a first piping structure and an internal power transfer device configured for disposition around a second piping structure. The external power transfer device receives a first surface current from the first piping structure. The external power transfer device is magnetically coupled to the internal power transfer device; therefore, the first surface current induces a secondary current in the internal power transfer device.

In another embodiment of the present invention, a power supply apparatus includes a similar external power transfer device and internal power transfer device disposed around a first piping structure and a second piping structure, respectively. Again, the two power transfer devices are magnetically coupled. The internal power transfer device is configured to receive a first downhole current, which induces a second downhole current in the external power transfer device.

A petroleum well according to the present invention includes a casing and tubing string positioned within a borehole of the well, the tubing string being positioned and longitudinally extending within the casing. The petroleum well further includes an external power transfer device positioned around the casing and magnetically coupled to an internal power transfer device that is positioned around the tubing string.

A method for supplying current within a first piping structure includes the step of providing an external power transfer device and an internal power transfer device that is inductively coupled to the external power transfer device. The external power transfer device is positioned around and inductively coupled to the first piping structure, while the internal power transfer device is positioned around a second piping structure. The method further includes the steps of coupling a main surface current to the first piping structure and inducing a first surface current within the external power transfer device. The first surface current provides the final step of inducing a second surface current within the internal power transfer device.

Figure 1:
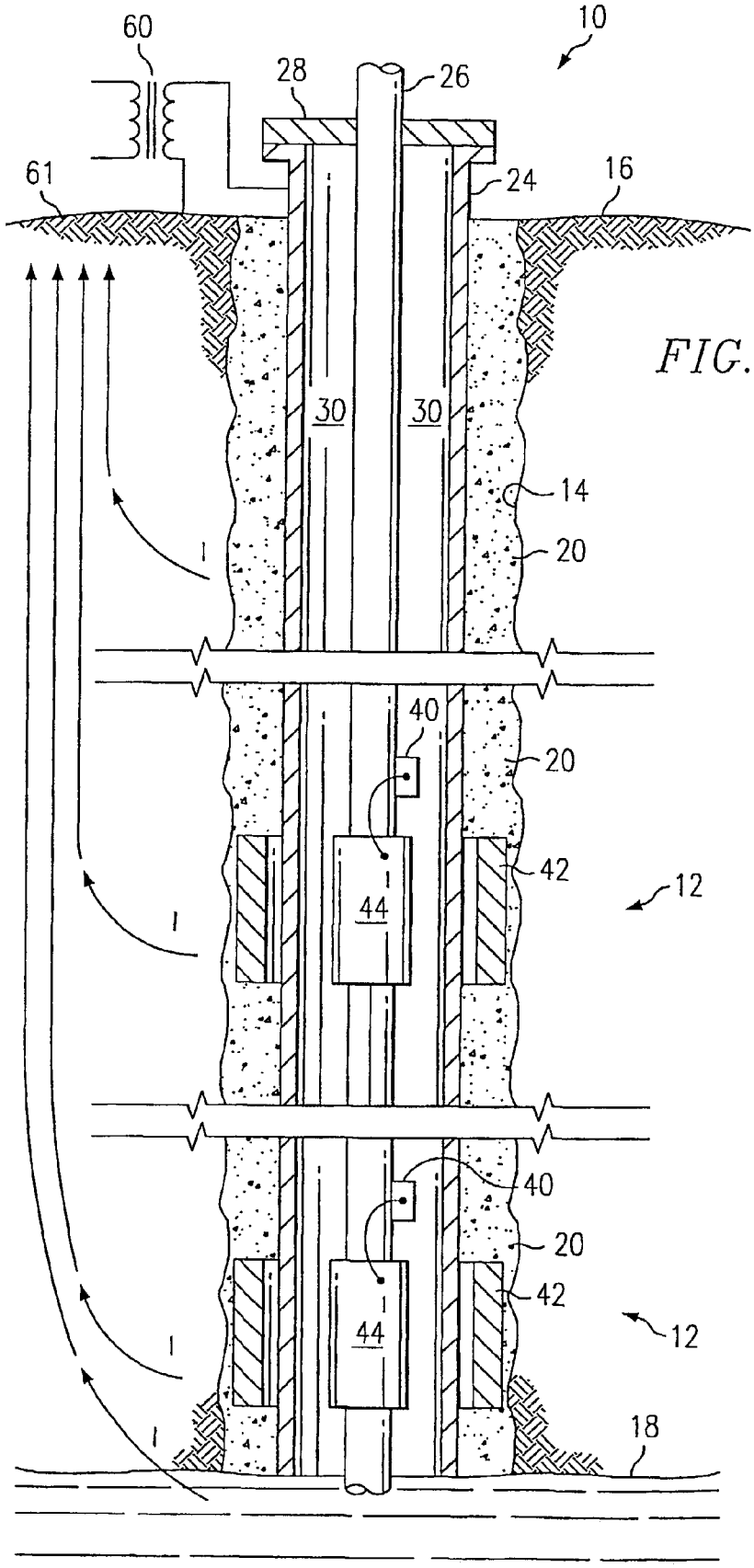
FIG. 1 is a schematic of an oil or gas well having multiple power pick-off points in accordance with the present invention, the well having a tubing string and a casing positioned within a borehole.

Appendix A is a description of a design analysis for a solenoid transformer coil design and a toroidal transformer coil design.

Appendix B is a series of graphs showing the power available as a function of frequency and of depth (or length) in a petroleum well under different conditions for rock and cement conductivity.

DETAILED DESCRIPTION OF THE INVENTION

As used in the present application, a "piping structure" can be one single pipe, a tubing string, a well casing, a pumping rod, a series of interconnected pipes, rods, rails, trusses, lattices, supports, a branch or lateral extension of a well, a network of interconnected pipes, or other structures known to one of ordinary skill in the art. The preferred embodiment makes use of the invention in the context of an oil well where the piping structure comprises tubular, metallic, electrically-conductive pipe or tubing strings, but the invention is not so limited. For the present invention, at least a portion of the piping structure needs to be electrically conductive, such electrically conductive portion may be the entire piping structure (e.g., steel pipes, copper pipes) or a longitudinal extending electrically conductive portion combined with a longitudinally extending non-conductive portion. In other words, an electrically conductive piping structure is one that provides an electrical conducting path from one location where a power source is electrically connected to another location where a device and/or electrical return is electrically connected. The piping structure will typically be conventional round metal tubing, but the cross-sectional geometry of the piping structure, or any portion thereof, can vary in shape (e.g., round, rectangular, square, oval) and size (e.g., length, diameter, wall thickness) along any portion of the piping structure.

A "valve" is any device that functions to regulate the flow of a fluid. Examples of valves include, but are not limited to, bellows-type gas-lift valves and controllable gas-lift valves, each of which may be used to regulate the flow of lift gas into a tubing string of a well. The internal workings of valves can vary greatly, and in the present application, it is not intended to limit the valves described to any particular configuration, so long as the valve functions to regulate flow. Some of the various types of flow regulating mechanisms include, but are not limited to, ball valve configurations, needle valve configurations, gate valve configurations, and cage valve configurations. The methods of installation for valves discussed in the present application can vary widely. Valves can be mounted downhole in a well in many different ways, some of which include tubing conveyed mounting configurations, side-pocket mandrel configurations, or permanent mounting configurations such as mounting the valve in an enlarged tubing pod.

The term "modem" is used generically herein to refer to any communications device for transmitting and/or receiving electrical communication signals via an electrical conductor (e.g., metal). Hence, the term is not limited to the acronym for a modulator (device that converts a voice or data signal into a form that can be transmitted)/demodulator (a device that recovers an original signal after it has modulated a high frequency carrier). Also, the term "modem" as used herein is not limited to conventional computer modems that convert digital signals to analog signals and vice versa (e.g., to send digital data signals over the analog Public Switched Telephone Network). For example, if a sensor outputs measurements in an analog format, then such measurements may only need to be modulated (e.g., spread spectrum modulation) and transmitted—hence no analog-to-digital conversion is needed. As another example, a relay/slave modem or communication device may only need to identify, filter, amplify, and/or retransmit a signal received.

The term "sensor" as used in the present application refers to any device that detects, determines, monitors, records, or otherwise senses the absolute value of or a change in a physical quantity. Sensors as described in the present application can be used to measure temperature, pressure (both absolute and differential), flow rate, seismic data, acoustic data, pH level, salinity levels, valve positions, or almost any other physical data.

As used in the present application, "wireless" means the absence of a conventional, insulated wire conductor e.g. extending from a downhole device to the surface. Using the tubing and/or casing as a conductor is considered "wireless."

The term "electronics module" in the present application refers to a control device. Electronics modules can exist in many configurations and can be mounted downhole in many different ways. In one mounting configuration, the electronics module is actually located within a valve and provides control for the operation of a motor within the valve. Electronics modules can also be mounted external to any particular valve. Some electronics modules will be mounted within side pocket mandrels or enlarged tubing pockets, while others may be permanently attached to the tubing string. Electronics modules often are electrically connected to sensors and assist in relaying sensor information to the surface of the well. It is conceivable that the sensors associated with a particular electronics module may even be packaged within the electronics module. Finally, the electronics module is often closely associated with, and may actually contain, a modem for receiving, sending, and relaying communications from and to the surface of the well. Signals that are received from the surface by the electronics module are often used to effect changes within downhole controllable devices, such as valves. Signals sent or relayed to the surface by the electronics module generally contain information about downhole physical conditions supplied by the sensors.

In accordance with conventional terminology of oilfield practice, the descriptors "upper," "lower," "uphole," and "downhole" as used herein are relative and refer to distance along hole depth from the surface, which in deviated or horizontal wells may or may not accord with vertical elevation measured with respect to a survey datum.

Referring to FIG. 1 in the drawings, a petroleum well 10 having a plurality of power pick-off points 12 is illustrated. Petroleum well 10 includes a borehole 14 extending from a surface 16 into a production zone 18 that is located downhole. A casing, or first piping structure, 24 is disposed in borehole 14 and is of the type conventionally employed in the oil and gas industry. The casing 24 is typically installed in sections and is secured in borehole 14 during well completion with cement 20. A tubing string, or second piping structure, 26 or production tubing, is generally conventional comprising a plurality of elongated tubular pipe sections joined by threaded couplings at each end of the pipe sections. Tubing string 26 is hung within borehole 14 by a tubing hanger 28 such that the tubing string 26 is concentrically located within casing 24. An annulus 30 is formed between tubing string 26 and casing 24. Oil or gas produced by petroleum well 10 is typically delivered to surface 16 by tubing string 26.

Tubing string 26 supports a number of downhole devices 40, some of which may include wireless communications devices such as modems or spread-spectrum transceivers, sensors measuring downhole conditions such as pressure or temperature, and/or control devices such as motorized valves. Downhole devices 40 have many different functions and uses, some of which are described in the applications incorporated herein by reference. The overall goal of downhole devices 40 is to assist in increasing and maintaining efficient production of the well. This function is realized by providing sensors that can monitor downhole physical conditions and report the status of these conditions to the surface of the well. Controllable valves located downhole are used to effect changes in well production. By monitoring downhole physical conditions and comparing the data with theoretically and empirically obtained well models, a computer at surface 16 of the well can change settings on the controllable valves, thereby adjusting the overall production of the well.

Power and communication signals are supplied to downhole devices 40 at global pick-off points 12. Each pick-off point 12 includes an external power transfer device 42 that is positioned concentrically around an exterior surface of casing 24 and an internal power transfer device 44 that is positioned concentrically around tubing string 26. External power transfer device 42 is installed at the time casing 24 is installed in borehole 14 and before the completion cement 20 has been placed. During completion of the well, cement 20 is poured in a space between borehole 14 and casing 24 and serves to further secure external power transfer device 42 relative to the casing 24. Internal power transfer device 44 is positioned around tubing string 26 such that internal power transfer device 44 is axially aligned with external power transfer device 42.

A low-voltage/high-current AC source 60 is coupled to well casing 24 and a formation ground 61. Current supplied by source 60 travels through the casing and dissipates progressively through cement 20 into formation ground 61, since cement 20 forms a resistive current path between the casing 24 and the formation ground 61, i.e. the cement restricts current flow but is not an ideal electrical insulator. Thus, the casing current at any specific point in the well is the difference between the current supplied by source 60 and the current which has leaked through the cement 20 into formation ground 61 between surface 16 and that specific point in the well.

Figure 2:
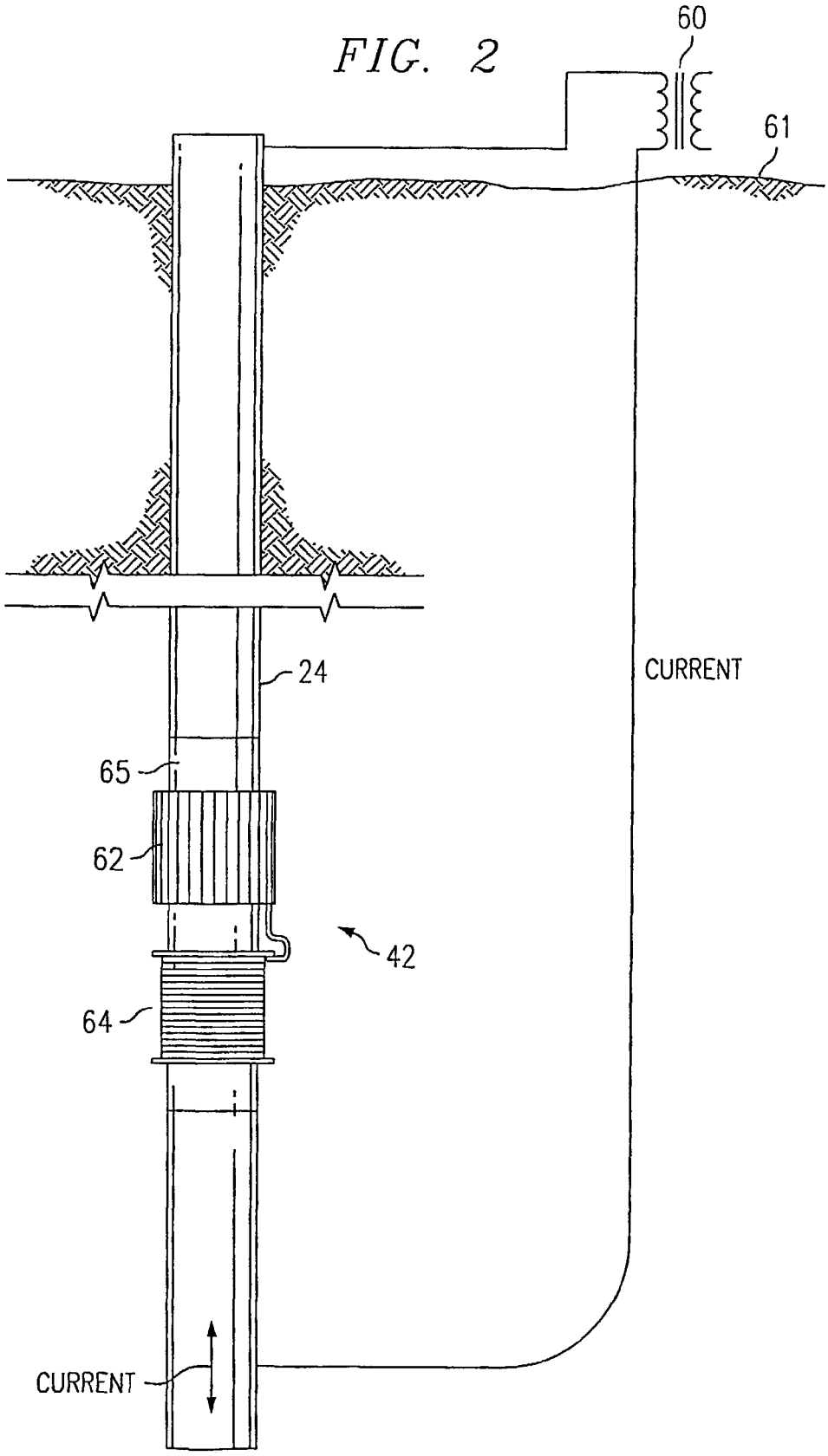
FIG. 2 is a detailed schematic of an external power transfer device installed around an exterior surface of the casing of FIG. 1.

Referring to FIG. 2 in the drawings, external power transfer device 42 is illustrated in more detail. Each external power transfer device 42 is comprised of a toroidal transformer coil 62 wound on a high magnetic permeability core, and a primary solenoid transformer coil 64. The winding of toroidal transformer coil 62 is electrically connected to the winding of primary solenoid transformer coil 64 such that current in the windings of toroidal transformer coil 62 passes through the windings of primary solenoid transformer coil 64. A section 65 of casing 24 passing through external power transfer device 42 is fabricated of a non-magnetic material such as stainless steel.

Figure 3:
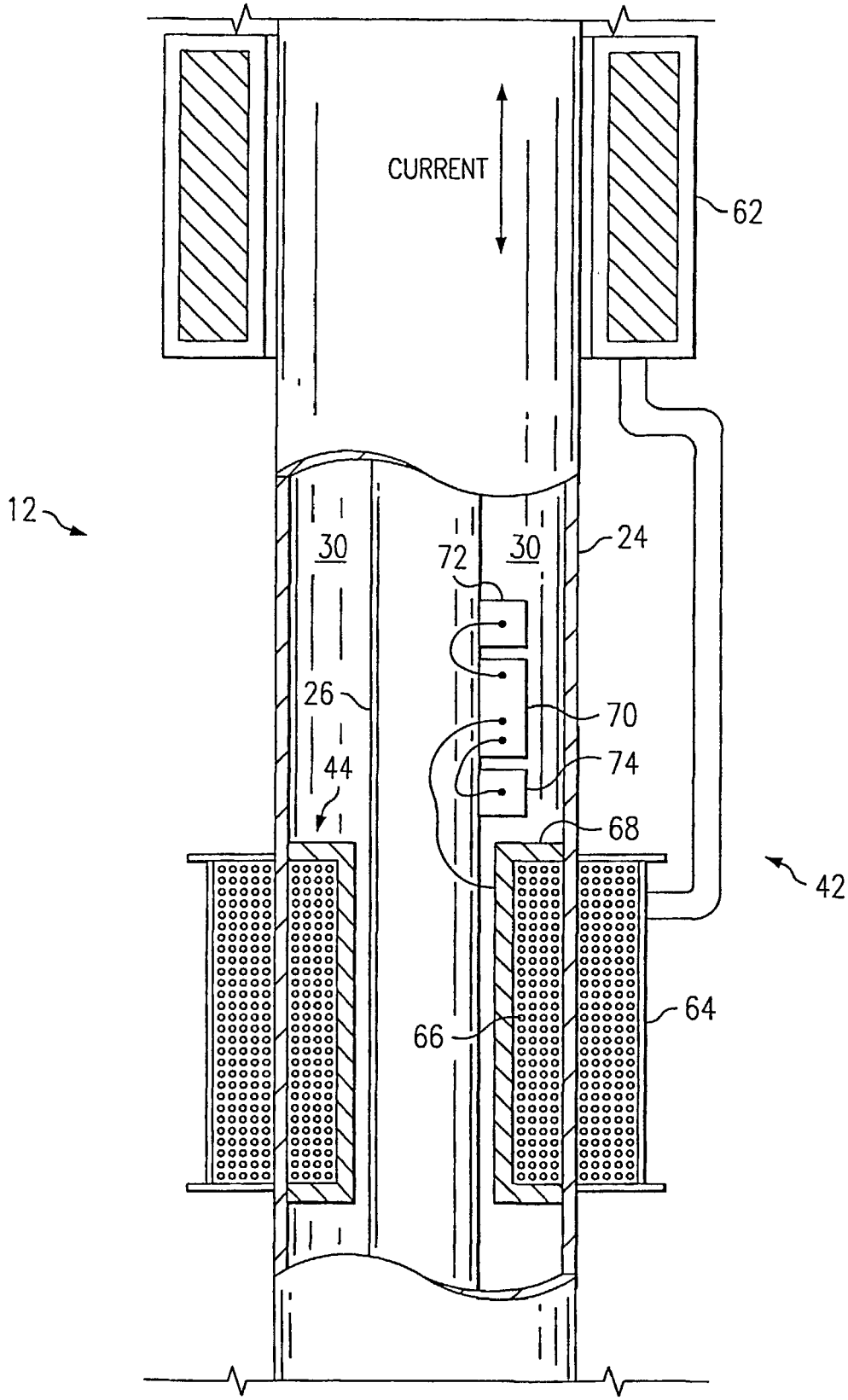
FIG. 3 is a detailed schematic showing a magnetic coupling between the external power transfer device of FIG. 2 and an internal power transfer device positioned within the casing.

In operation, a main surface current is supplied to casing 24. Usually the main surface current will be supplied by source 60, but it is conceivable that a communications signal originating at the surface or one of the downhole devices 40 is being relayed along casing 24. The main surface current has an associated magnetic field that induces a first surface current in the windings of toroidal transformer coil 62. The first surface current induced in toroidal transformer coil 62 is then driven through the winding of primary solenoid transformer coil 64 to create a solenoidal magnetic field within casing 24. A secondary solenoid transformer coil 66 may be inserted into this magnetic field as shown in FIG. 3. The solenoidal magnetic field inside casing 24 induces a second surface current in the windings of the secondary solenoid transformer coil 66 (see FIG. 3). This induced second surface current may be used to provide power and communication to downhole devices within the well bore (e.g. sensors, valves, and electronics modules).

Referring to FIG. 3 in the drawings, internal power transfer device 44 and external power transfer device 42 are illustrated in more detail. Internal power transfer device 44 comprises the secondary solenoid transformer coil 66 wound on a high magnetic permeability core 68. Internal power transfer device 44 is located such that secondary solenoid transformer coil 66 is immersed in the solenoidal magnetic field generated by primary solenoid transformer coil 64 around casing 24. The total assembly of toroidal transformer coil 62, primary solenoid transformer coil 64, and secondary solenoid transformer coil 66, forms a means to transfer power flowing on casing 24 to a point of use within casing 24. Notably this power transfer is insensitive to the presence of conducting fluids such as brine within annulus 30 between casing 24 and tubing string 26.

Power and communications supplied at power pick-off point 12 are routed to one or more downhole devices 40. In FIG. 3 power is routed to an electronics module 70 that is electrically coupled to a plurality of sensors 72 and a controllable valve 74. Electronics module 70 distributes power and communication signals to sensors 72 and controllable valve 74 as needed to obtain sensor information and to power and control the valve.

It will be clear that while the description of the present invention has used transmission of power from the casing to the inner module as its primary focus, the entire system is reversible such that power and communications may also be transferred from the internal power transfer device to the casing. In such a system, a communications signal such as sensor information is routed from electronics module 70 to secondary solenoid transformer coil 66. The signal is provided to the transformer coil 66 as a first downhole current. The first downhole current has an associated solenoidal magnetic field, which induces a second downhole current in the windings of primary solenoidal transformer coil 64. The second downhole current passes into the windings of toroidal transformer coil 62, which induces a main downhole current in casing 24. The main downhole current then communicates the original signal from electronics module 70 to other downhole devices 40 or to equipment at the surface 16 of the well. Various forms of implementation are possible, e.g., the electronics module 70 may include a power storage device such as a battery or capacitor The battery or capacitor is charged during normal operation. When it is desired to communicate from the module 70, the battery or capacitor supplies the power.

It should be noted that the use of the words "primary" and "secondary" with the solenoid transformer coils 64, 66 are naming conventions only, and should not be construed to limit the direction of power transfer between the solenoid transformer coils 64, 66.

A number of practical considerations must be borne in mind in the design of toroidal transformer coil 62 and primary solenoid transformer coil 64. To protect against mechanical damage during installation, and corrosion in service, the coils are encapsulated in a glass fiber reinforced epoxy sheath or equivalent non-conductive material, and the coil windings are filled with epoxy or similar material to eliminate voids within the winding assembly. For compatibility with existing borehole and casing diameter combinations an external diameter of the completed coil assembly (i.e. external power transfer device 42) must be no greater than the diameter of the casing collars. For ease of manufacturing, or cost, it may be desirable to compose the toroidal transformer coil 62 of a series of tori which are stacked on the casing and whose outputs are coupled to aggregate power transfer. Typically the aggregate length of the torus assembly will be of the order of two meters, which is relatively large compared to standard manufacturing practice for toroidal transformers, and for this reason if no other the ability to divide the total assembly into sub-units is desirable.

Figure 4:
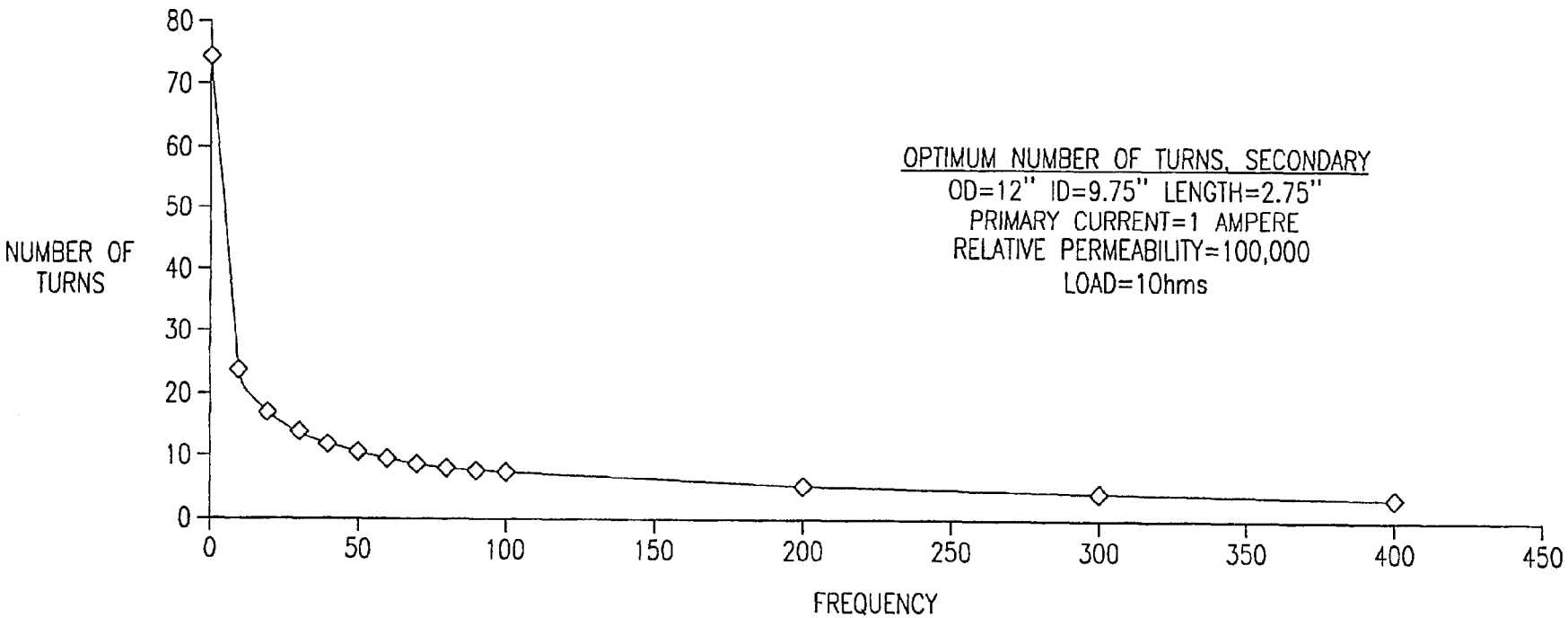
FIG. 4 is a graph showing results from a design analysis for a toroidal transformer coil with optimum number of secondary turns on the ordinate as a function of AC operating frequency on the abscissa.

The design analyses for toroidal transformer coil 62 and primary solenoid transformer coil 64 is derived from standard practice for transformer design with account taken of the novel geometries of the present invention. The casing is treated as a single-turn current-carrying primary for the toroidal transformer design analysis. Appendix A provides the mathematical treatment of this design analysis. FIG. 4 illustrates the results from such a design analysis, in this case showing how the optimum number of turns on toroidal transformer coil 62 depends on the frequency of the AC power being supplied on casing 24.

Figure 5:
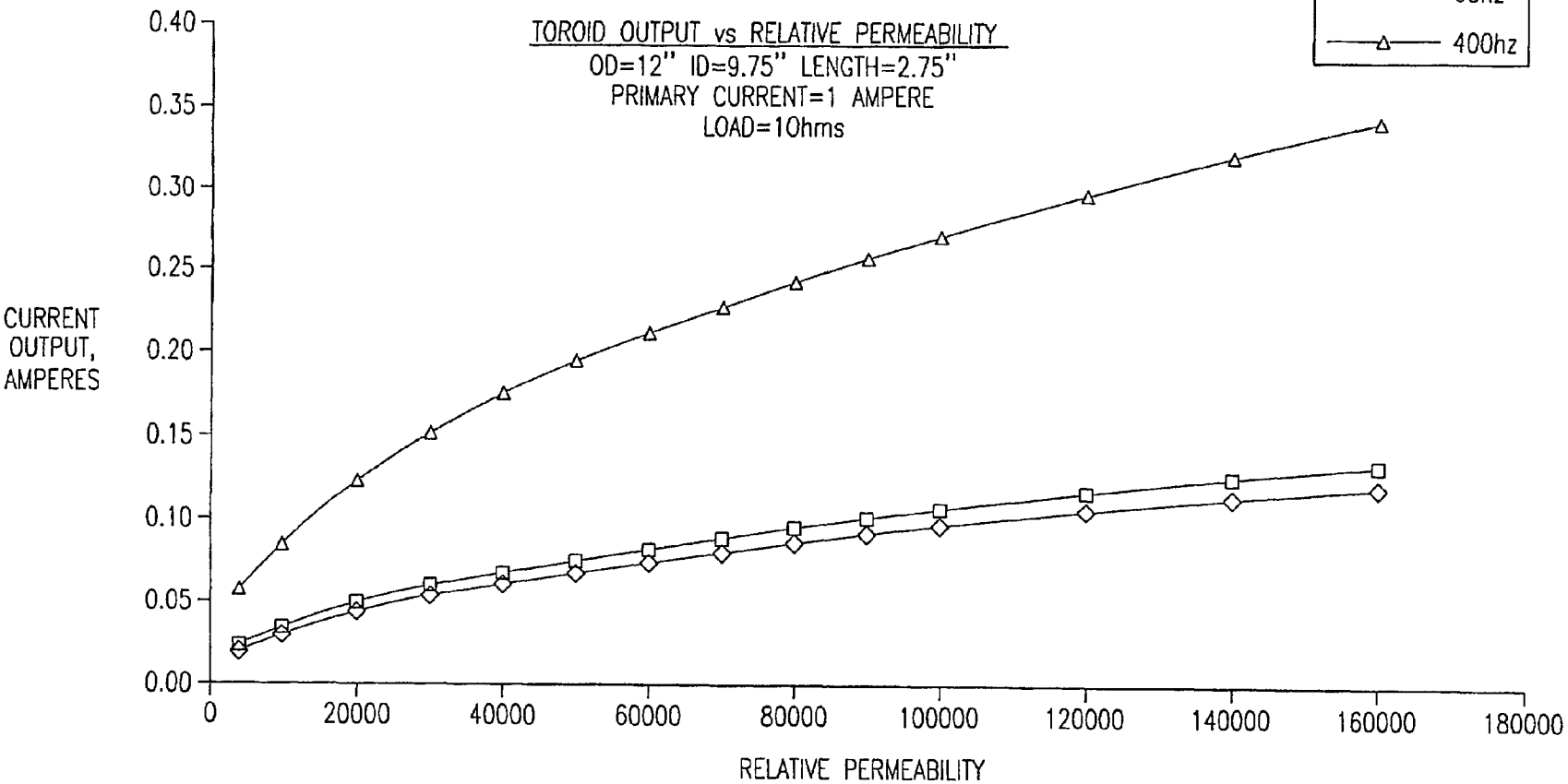
FIG. 5 is a graph showing results from a design analysis for a toroidal transformer coil with output current on the ordinate as a function of relative permeability on the abscissa.
Figure 1:
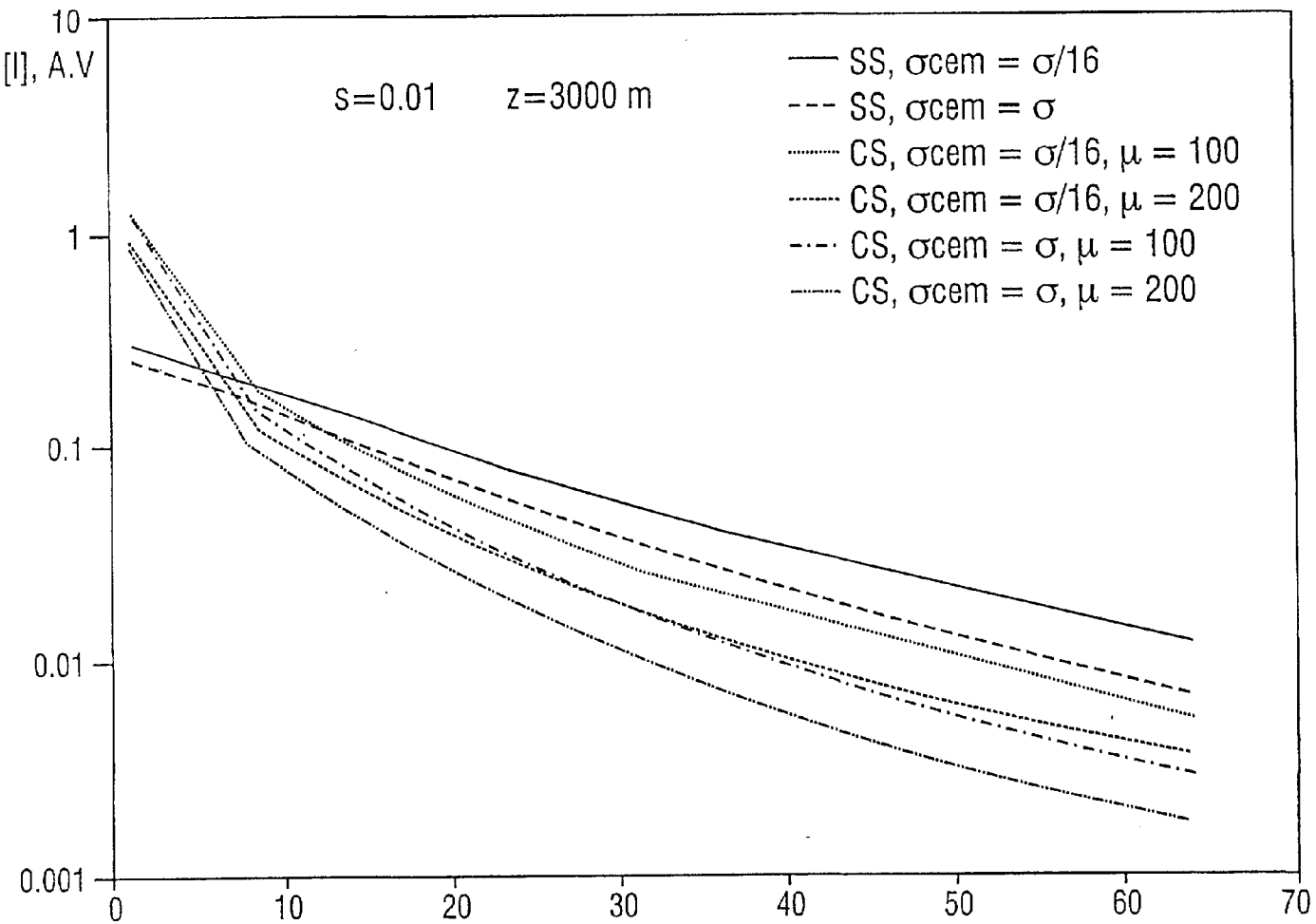
Figure 2:
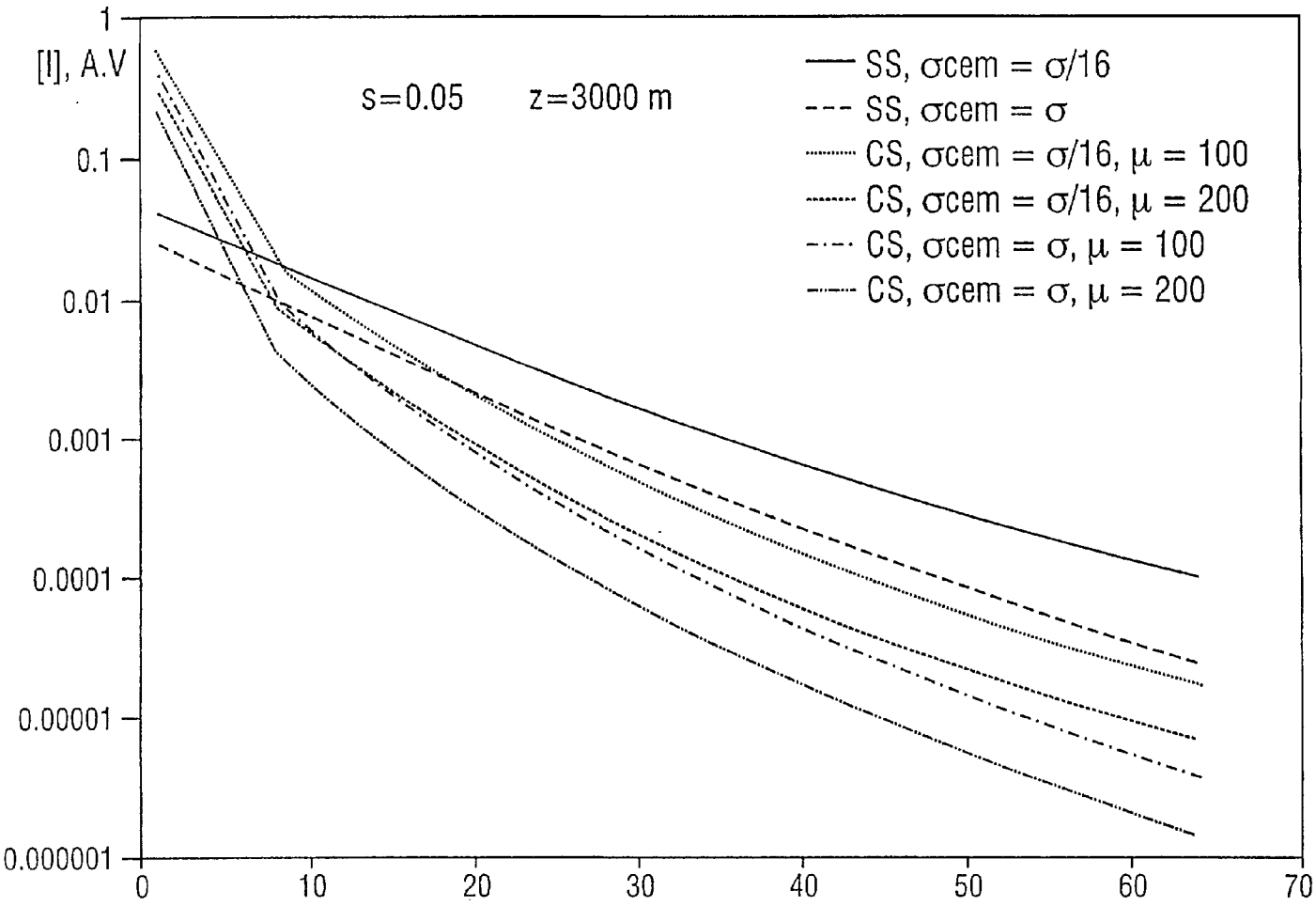
Figure 3:
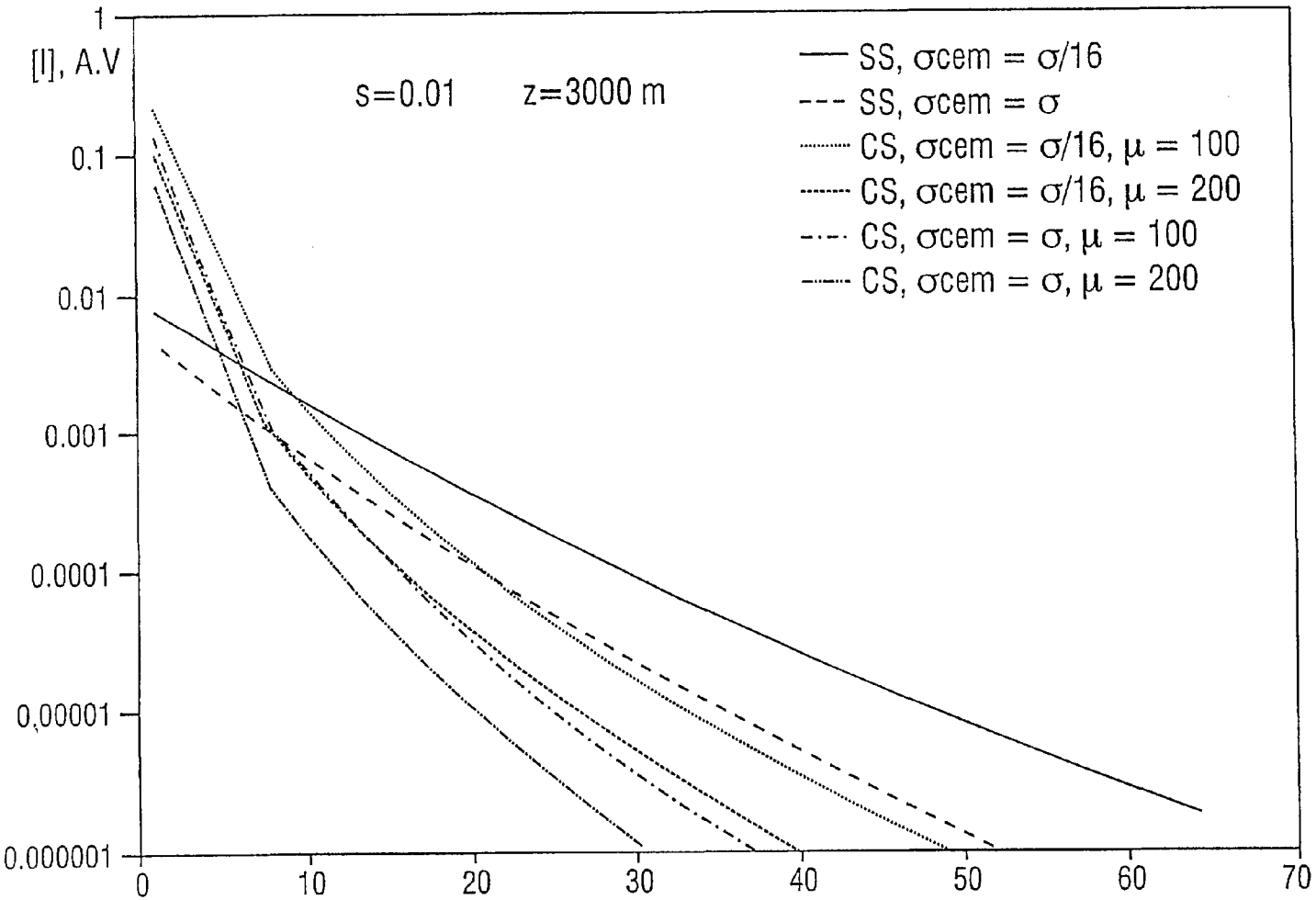

FIG. 5 illustrates results of an analysis showing how relative permeability of the toroid core material affects current available into a 10-Ohm load, for three representative power frequencies, 50 Hz, 60 Hz and 400 Hz. These results show the benefit of selecting high permeability materials for the toroidal transformer core. Permalloy, Supermalloy, and Supermalloy-14 are specific examples of candidate materials, but in general, the requirement is a material exhibiting low excitation Oersted and high saturation magnetic field. The results also illustrate the benefit of selecting the frequency and number of turns of the torus winding to match the load impedance.

The design analysis for electrical conduction along the casing requires knowledge of the rate at which power is lost from the casing into the formation. A semi-analytical model can be constructed to predict the propagation of electrical current along such a cased well. The solution can be written as an integral, which has to be evaluated numerically. Results generated by the model were compared with published data and show excellent agreement.

The problem under consideration consists of a well surrounded by a homogeneous rock with cement placed in between. A constant voltage is applied to the outer wall of the casing. With reference to the present invention, the well is assumed to have infinite length; however, a finite length well solution can also be constructed. Results obtained by analyzing both models show that the end effects are insignificant for the cases considered.

The main objectives of the analysis for electrical conduction along the casing are:

To calculate the current transmitted along the well;

To determine the maximum depth at which significant current could be observed;

To study the influence of the controlling parameters, especially, conductivity of the rock, and frequency.

To simplify the problem, the thickness of the casing is assumed to be larger than its skin depth, which is valid for all cases considered. As a result, the well can be modeled as a solid rod. Each material (pipe, cement, and rock) is characterized by a set of electromagnetic constants: conductivity $\sigma$, magnetic permeability $\mu$, and dielectric constant $\epsilon$. Metal properties are well known; however, the properties of the rock as well as the cement vary significantly depending on dryness, water and oil saturation. Therefore, a number of different cases were considered.

The main parameter controlling the current propagation along the casing of the well is the rock conductivity. Usually it varies from 0.001 to 0.1 mho/m. In this study, three cases were considered: $\sigma_{rock}$=0.01, 0.05, 0.1 mho/m. To study the influence of the cement conductivity relative to the rock conductivity, two cases were analyzed: $\sigma_{cement}=\sigma_{rock}$ and $\sigma_{cement}=\sigma_{rock}/16$ (resistive cement). In addition, it was assumed that the pipe was made of either carbon steel with resistivity of about $18\times10^{-8}$ ohm-m and relative magnetic permeability varying from 100 to 200, or stainless steel with resistivity of about $99\times10^{-8}$ ohm-m and relative magnetic permeability of 1. A series of graphs showing the power available as a function of frequency and of depth (or length) in a petroleum well under different conditions for rock and cement conductivity is illustrated in Appendix B.

The results of the modeling can be summarized as follows:

It was shown that significant current (minimum value of 1A corresponding to 100V applied) could be observed at depths up to 3000 m.

If rock is not very conductive ($\sigma_{rock}$=0.01 or less), the wide range of frequencies (up to 60 Hz or even more) could be used. This could be a case of an oil-bearing reservoir.

For less conductive rock, the frequencies should be less than about 12 Hz.

Generally, stainless steel is preferable for the casing; carbon steel has an advantage only for very low frequencies (less than 8 Hz).

Presence of the resistive cement between casing and rock helps in situations, when rock conductivity is high.

Even though many of the examples discussed herein are applications of the present invention in petroleum wells, the present invention also can be applied to other types of wells, including but not limited to water wells and natural gas wells.

One skilled in the art will see that the present invention can be applied in many areas where there is a need to provide a communication system or power within a borehole, well, or any other area that is difficult to access. Also, one skilled in the art will see that the present invention can be applied in many areas where there is an already existing conductive piping structure and a need to route power and communications to a location on the piping structure. A water sprinkler system or network in a building for extinguishing fires is an example of a piping structure that may be already existing and may have a same or similar path as that desired for routing power and communications. In such case another piping structure or another portion of the same piping structure may be used as the electrical return. The steel structure of a building may also be used as a piping structure and/or electrical return for transmitting power and communications in accordance with the present invention. The steel rebar in a concrete dam or a street may be used as a piping structure and/or electrical return for transmitting power and communications in accordance with the present invention. The transmission lines and network of piping between wells or across large stretches of land may be used as a piping structure and/or electrical return for transmitting power and communications in accordance with the present invention. Surface refinery production pipe networks may be used as a piping structure and/or electrical return for transmitting power and communications in accordance with the present invention. Thus, there are numerous applications of the present invention in many different areas or fields of use.

It should be apparent from the foregoing that an invention having significant advantages has been provided. While the invention is shown in only a few of its forms, it is not just limited but is susceptible to various changes and modifications without departing from the spirit thereof.

APPENDIX A

Solenoid transformer design

The model developed in the following outline will calculate input current and voltage for a required output voltage and load or it will calculate the input current and output voltage for a fixed input voltage and load. These calculations are based on the following input parameters:

Dimensions

Length of the inner core, $l_{incr}$, minimum diameter of the inner core, $D_{\min,incr}$, maximum diameter of the inner core, $D_{\max,incr}$, gap width between the inner and outer cores, $W_{gap}$, maximum diameter of outer core, $D_{\max,outcr}$, length of the coils, $l_{coil}$, maximum diameter of the outer coil, $D_{\max,coil}$, number of primary turns, $N_{prim}$, and number of secondary turns, $N_{\sec}$.

Material constants

Filling factor of the copper wires, $K_u$, specific resistivity of magnet wire copper, $\rho_{cu}$, relative permeability of the inner and outer cores; $\mu_{r,incr}$ and $\mu_{r,outcr}$, specific core losses in terms of: $P_{spec,core} = af^{\alpha}B^{\beta}$ Operating conditions Temperature, $T$, frequency, $f$, load resistance, $R_{load}$, and the required input or output voltage, $V_{in}$, or $V_{out}$.

The reluctance (magnetic resistance) of a core is given by:

$$R_{m,core} = \frac{l_{core}}{\mu_o \mu_r A_{core}} \qquad \#$$

where $l_{core}$ is the length and $A_{core}$ is the cross sectional area.

For the primary coil, the magnetic reluctance is the sum of the reluctance of the outer core and the combined reluctance of the leakage path and the path through the gap and the inner core. The total reluctance of the primary (or outer) core is then given by:

$$R_{m,prim} = R_{m,outcore} + \frac{R_{m,leak}(R_{m,incore} + 2R_{m,gap})}{R_{m,leak} + R_{m,incore} + 2R_{m,gap}} \qquad \#$$

where $R_{m,gap}$ is doubled because the gap is crossed twice.

In a similar manner, the reluctance of the secondary coil is given by:

$$R_{m,\sec} = R_{m,incore} + \frac{R_{m,leak}(R_{m,outcore} + 2R_{m,gap})}{R_{m,leak} + R_{m,outcore} + 2R_{m,gap}} \qquad \#$$

The cross sectional area of the outer core is given by:

$$A_{outcr} = \frac{\pi}{4}(D^2_{\max,outcr} - D^2_{\max,coil}) \qquad \#$$

and the length of the outer core is $$l_{outr} = l_{coil} + \frac{D_{\max,outcr} + D_{\max,coil} - 2D_{\max,incr} - 4W_{gap}}{2} + \frac{D_{\max,coil}}{2} \quad \#$$

The cross sectional area of the inner core is given by:

$$A_{incr} = \frac{\pi}{4} D^2_{\min,incr} \quad \#$$

and the length of the inner core is $$l_{incr} = l_{coil} + D_{\max,incr} + \frac{D_{\min,incr}}{2} \quad \#$$

The cross sectional area of the gap is given by:

$$A_{gap} = \pi(D_{gap} + W_{gap})(l_{incr} - l_{coil}) \quad \#$$

The cross sectional area for leakage reluctance calculation is given by:

$$A_{leak} = \frac{\pi}{4}(d^2_{avg} - d^2_{avg}) \quad \#$$

and the length of the leakage gap is $$l_{leak} = \frac{l_{incr} + l_{coil}}{2} \quad \#$$

$d_{avg,pri}$ and $d_{avg,\sec}$ are developed by:

$$d_{avg,pri} = \frac{D_{\max,outcr} + D_{\max,incr} + 2W_{gap}}{2} \quad \#$$

$$d_{avg,\sec} = \frac{D_{\max,incr} + D_{\min,incr}}{2} \quad \#$$

The inductance of the two coils is split into main and leakage components:

$$L = L_m + L_{leak} \quad \#$$

The main component is denoted by the $m$ subscript. The components are then derived by:

$$L_{prim,m} = L_{prim} \frac{R_{m,leak}}{R_{m,leak} + R_{m,core} + 2R_{m,gap}} \quad \#$$

$$L_{prim,leak} = L_{prim} \frac{R_{m,incore} + 2R_{m,gap}}{R_{m,leak} + R_{m,core} + 2R_{m,gap}} \quad \#$$

$$L_{\sec,m} = L_{\sec} \frac{R_{m,leak}}{R_{m,leak} + R_{m,outcore} + 2R_{m,gap}} \quad \#$$

$$L_{\sec,leak} = L_{\sec} \frac{R_{m,incore} + 2R_{m,gap}}{R_{m,leak} + R_{m,outcore} + 2R_{m,gap}} \quad \#$$

The mutual inductance of the two coils is given by:

$$M = \sqrt{L_{mprim}, L_{\sec,m}} \quad \#$$

and the coupling coefficient is defined by the relation $$M = k\sqrt{L_{prim}L_{\sec}} \quad \#$$

and can be written as $$k = \sqrt{\frac{L_{prim,m}L_{\sec,m}}{L_{prim}L_{\sec}}} \quad \#$$

The resistive core losses of this configuration are very small compared to the inductive core losses and will be ignored.

The core losses are given by:

$$P_{core} = P_{spec,incr}VOL_{incr} + P_{spec,outcr}VOL_{outcr} \quad \#$$

where the specific core losses are derived by:

$$P_{spec} = af^{\alpha}B^{\beta} \quad \#$$

Since Permalloy is used in this model for both cores, the above equation works for both cores.

For Permalloy, the material constants are:

$a = 2.4$
$\alpha = 1.79$
$\beta = 2.01$
$\mu_r = 35,000$ $B$ is given by:

$$B = \frac{V_{out}}{2\pi f N_{\sec} A_{core}} \quad \#$$

The core losses in the parts of the cores where the inner and outer cores are close are difficult to calculate, as no uniform flux density exists in these parts. To estimate these losses, an identical flux density as in the middle parts of the cores is assumed. The effective volume of these parts where core losses occur is then determined by the requirement that the total flux through these parts is identical to the total flux through the middle parts. The total effective volumes of the two cores for the calculation of the core loss are given by:

$$VOL_{incr} = A_{incr}l_{incr} + \frac{\pi}{8}D^2_{\max,incr}D_{\min,incr} \quad \#$$

$$VOL_{outcr} = A_{outcr}l_{coil} + \frac{\pi}{8}(D^2_{\max,outcr} - (D_{\max,incr} + 2W_{gap})^2)D_{\max,coil} \quad \#$$

The values for core resistance dissipate approximately equal amounts of power so the values are given by:

$$R_{core,\sec} = \frac{2V^2_{out}}{P_{core}} \quad \#$$

$$R_{core,prim} = \frac{2V_{out}^2}{P_{core}} \frac{N_{prim}^2}{N_{sec}^2} \quad \#$$

The transformer can be described as a transfer function and can be given in matrix representation:

$$\begin{bmatrix} V_{in} \\ I_{in} \end{bmatrix} = \begin{bmatrix} S_1 & S_2 \\ S_3 & S_4 \end{bmatrix} \begin{bmatrix} V_{out} \\ I_{out} \end{bmatrix}$$

where:

$$S_1 = \frac{R_{prim}}{R_{core,sec}} \frac{L_{sec}}{M} + \left(1 + \frac{R_{prim}}{R_{core,prim}}\right) \frac{L_{prim}}{M} \quad \#$$
$$+ i\left[\frac{1-k^2}{k^2} \frac{\omega M}{R_{core,sec}} \left(1 + \frac{R_{prim}}{R_{core,prim}}\right) - \frac{R_{prim}}{\omega M}\right] \quad \#$$

$$S_2 = R_{sec}\left(1 + \frac{R_{prim}}{R_{core,prim}}\right) \frac{L_{prim}}{M} + R_{prim}\left(1 + \frac{R_{sec}}{R_{core,sec}}\right) \frac{L_{sec}}{M} \quad \#$$
$$+ i\left[\frac{1-k^2}{k^2} \omega M \left(1 + \frac{R_{prim}}{R_{core,prim}}\right)\left(1 + \frac{R_{sec}}{R_{core,sec}}\right) - \frac{R_{prim} R_{sec}}{\omega M}\right] \quad \#$$

$$S_3 = \frac{1}{R_{core,prim}} \frac{L_{prim}}{M} + \frac{1}{R_{core,sec}} \frac{L_{sec}}{M} \quad \#$$
$$+ i\left[\frac{1-k^2}{k^2} \frac{\omega M}{R_{core,prim} R_{core,sec}} - \frac{1}{\omega M}\right] \quad \#$$

$$S_4 = \frac{R_{sec}}{R_{core,prim}} \frac{L_{prim}}{M} + \left(1 + \frac{R_{sec}}{R_{core,sec}}\right) \frac{L_{sec}}{M} \quad \#$$
$$+ i\left[\frac{1-k^2}{k^2} \frac{\omega M}{R_{core,prim}} \left(1 + \frac{R_{sec}}{R_{core,sec}}\right) - \frac{R_{sec}}{\omega M}\right] \quad \#$$

Combining the results for the toroidal and solenoidal transformers the overall system transfer function is:

$$\begin{bmatrix} V_{in} \\ I_{in} \end{bmatrix} = \begin{bmatrix} T_1 & T_2 \\ T_3 & T_4 \end{bmatrix} \begin{bmatrix} S_1 & S_2 \\ S_3 & S_4 \end{bmatrix} \begin{bmatrix} V_{out} \\ I_{out} \end{bmatrix}$$

where the S and T matrices follow the definitions given above.

Appendix B

Appendix B

Appendix B

We claim:

1. A power supply apparatus comprising:

an external power transfer device configured for disposition around a first piping structure, the external power transfer device configured to receive a first AC current from the first piping structure;

an internal power transfer device configured for disposition within the first piping structure in proximity to the external power transfer device;

a second piping structure configured for disposal within the first piping structure and carrying the internal power transfer device such that the internal power transfer device is axially aligned with the external power transfer device;

wherein the internal power transfer device is operable to produce a second current induced when the first AC current is supplied to the external power transfer device.

2. The power supply apparatus according to claim 1, wherein the first current received by the external power transfer device is induced by a main current flowing in the first piping structure.

3. The power supply apparatus according to claim 1, wherein a section of the first piping structure proximate the external power transfer device is made of non-magnetic material.

4. The power supply apparatus according to claim 1, wherein the external power transfer device includes a toroidal transformer coil electrically connected to a primary solenoid transformer coil.

5. The power supply apparatus according to claim 1, wherein:

the external power transfer device includes a toroidal transformer coil electrically connected to a primary solenoid transformer coil; and the first current is induced in the toroidal transformer coil by a main AC signal applied to the first piping structure.

6. The power supply apparatus according to claim 1, wherein the internal power transfer device includes a secondary solenoid transformer coil.

7. The power supply apparatus according to claim 1, wherein:

the external power transfer device includes a toroidal transformer coil electrically connected to a primary solenoid transformer coil;

the internal power transfer device includes a secondary solenoid transformer coil;

the first AC signal is induced in the toroidal transformer coil by a main AC signal flowing in the first piping structure; and the second AC signal is induced in the secondary solenoid transformer coil by the first AC signal flowing through the primary solenoid transformer coil.

8. The power supply apparatus according to claim 1, wherein the first piping structure is a casing positioned within a borehole of a petroleum well.

9. The power supply apparatus according to claim 1, wherein the second piping structure is a tubing string positioned within a borehole of a petroleum well.

10. The power supply apparatus according to claim 1, wherein:

the first piping structure is a casing positioned within a borehole of a petroleum well;

the internal power transfer device is coupled to a tubing string positioned within the casing; and the second AC signal induced in the internal power transfer device is used to provide power to a downhole device.

11. The power supply apparatus according to claim 1, wherein the downhole device is a sensor for determining a physical characteristic.

12. A method of producing a remote AC signal within a first piping structure comprising:

providing an external power transfer device configured for disposition around the first piping structure;

providing an internal power transfer device configured for disposition within the first piping structure;

coupling a main AC signal to the first piping structure;

inducing a first AC signal within the external power transfer device using an inductive coupling between the first piping structure and the external power transfer device;

inducing a remote AC signal within the internal power transfer device using an inductive coupling between the external power transfer device and the internal power transfer device;

wherein the step of providing an external power transfer device further comprises the steps of:

positioning a toroidal transformer coil around the first piping structure;

positioning a primary solenoid transformer coil around the first piping structure;

electrically connecting the toroidal transformer coil to the primary solenoid transformer coil; and positioning a secondary solenoid transformer coil around a second piping structure disposed within the first piping structure, the secondary solenoid transformer coil being axially aligned with the external power transfer device.

13. The method according to claim 12, wherein the steps of providing internal and external power transfer devices further comprise the steps of:

positioning a toroidal transformer coil around the first piping structure;

positioning a primary solenoid transformer coil around the first piping structure;

electrically connecting the toroidal transformer coil to the primary solenoid transformer coil; and positioning a secondary solenoid transformer coil around a second piping structure disposed within the first piping structure such that the secondary solenoid transformer coil is axially aligned with the primary solenoid transformer coil.

14. The method according to claim 13, wherein the steps of inducing first AC signal and remote AC signal further comprise the steps of:

inducing the first AC signal within the toroidal transformer coil using the main AC signal flowing within the first piping structure;

passing the first AC signal from the toroidal transformer coil to the primary solenoid transformer coil; and inducing the remote AC signal within the secondary solenoid transformer coil using the first AC signal flowing within the primary solenoid transformer coil.

15. The method according to claim 13, wherein the first piping structure is a casing positioned within a borehole of a petroleum well and the second piping structure is a tubing string positioned within the casing.

16. The method according to claim 12, including providing power and communications to powering a downhole device using the remote AC signal.

* * * * *